United States Patent [19]

Yff

[11] Patent Number: 4,967,981

[45] Date of Patent: Nov. 6, 1990

[54] SYSTEM FOR DETERMINING THE ANGULAR SPIN POSITION OF AN OBJECT SPINNING ABOUT AN AXIS

[75] Inventor: Louis S. Yff, Hengelo, Netherlands

[73] Assignee: Hollandse Signaalapparaten B.V., Hengelo, Netherlands

[21] Appl. No.: 347,313

[22] Filed: May 3, 1989

[30] Foreign Application Priority Data

May 9, 1988 [NL] Netherlands ..... 8801203
Jan. 19, 1989 [NL] Netherlands ..... 8900118

[51] Int. Cl.[5] ..... F41G 7/28
[52] U.S. Cl. ..... 244/3.21; 244/3.14
[58] Field of Search ..... 244/3.11, 3.14, 3.21

[56] References Cited

U.S. PATENT DOCUMENTS 2,995,749 8/1961 Robinson, Jr. ..... 244/3.14
4,219,170 8/1980 Esker ..... 244/3.14
4,328,938 5/1982 Reisman et al. ..... 244/3.21
4,750,689 6/1988 Yff ..... 244/3.14

*Primary Examiner*—Charles T. Jordan
*Assistant Examiner*—Rochelle Lieberman
*Attorney, Agent, or Firm*—Robert J. Kraus

[57] ABSTRACT

System for determining the angular spin position of an object (1) spinning about an axis situated within certain limits near the surface (2) of a celestial body. The system is provided with means (4, 5, 6) for generating at least one carrier wave (7, 8) reaching as far as the surroundings of the object (1) and up to and interfering with the surface (2). The system is further provided with directional receiving antenna means (16) fitted to the object (1) and a receiving system (19) linked thereto for determining the angular spin position of the object (1) with respect to the surface (2) on the basis of the angular spin position of the object (1) with respect to the polarization direction of the carrier wave (7, 8).

18 Claims, 8 Drawing Sheets

SYSTEM FOR DETERMINING THE ANGULAR SPIN POSITION OF AN OBJECT SPINNING ABOUT AN AXIS

BACKGROUND OF THE INVENTION

The invention relates to a system for determining the angular spin position of an object spinning about an axis. The object often concerns a projectile the course of which is to be corrected to hit a certain target.

Such systems are known from Netherlands Patent Application No. NL-A 8600710 and Netherlands Patent Appliction No. NL-A 8801203. In these systems at least one polarised carrier wave is transmitted by an antenna unit together with a transmitter unit linked to the antenna unit. The object is fitted with a directional receiving antenna means and a receiving system linked to the receiving antenna means. The system is arranged in such a way that the angular spin position of the object with respect to the antenna unit is measured. The orientation of the antenna unit therefore functions as a reference. For this purpose care is taken that the polarised carrier wave is present around the object. For illumination of the object, a pencil beam is often used. If one polarised carrier wave is transmitted, the angular spin position of the object can be determined with an uncertainty of 180°. Several methods are known to eliminate the 180° uncertainty. A few of these methods are discussed in the said Dutch patent applications. The present invention however also finds application in a system where the angular spin position of the object is determined with a 180° uncertainty.

Because the angular spin position of the object with respect to the antenna unit is measured, for the determination of the angular spin position of the object with respect to space it is also necessary to determine the orientation of the antenna unit with respect to space (the earth surface) and to keep it constant.

Said systems have the disadvantage that determination of the angular spin position of the object with respect to space is calculated on the basis of two measurements: the measurement of the angular spin position of the object with respect to the antenna unit and the measurement of the orientation of the antenna unit with respect to space. Because for the calculation of the angular spin position use is made of two measurements, the accuracy of the calculation will decrease.

Moreover, the software required for the calculation of the angular spin position of the object with respect to space is complicated and thus expensive.

If the antenna unit is placed on a ship, a stabilised platform is to be used onto which the antenna unit is fitted to keep the orientation of the antenna unit with respect to space (see surface) constant when the ship moves.

SUMMARY OF THE INVENTION

It is an object of the present invention to obviate above disadvantages and to obtain a system which accurately determines the angular spin position of the object with respect to space, comprises a simple and thus cheaper antenna unit and comprises simpler and thus cheaper software.

According to the invention, the system is provided with a transmitter unit and an antenna unit linked to the transmitter unit, which antenna unit generates at least one carrier wave reaching as far as the surroundings of the object and up to and interfering with the said surface, where the system is further provided with directional receiving antenna means fitted to the object and a receiving system linked to the receiving antenna means, which receiving system receives the carrier wave and determines the angular spin position of the object with respect to the surface on the basis of the angular spin position of the object with respect to the polarisation direction of the carrier wave and where the position and orientation of the antenna unit with respect to the surface is not determined.

The antenna unit has such a beam width that, in the first place, the surface of the celestial body, in this case the earth surface, is illuminated, and in the second place, the object is illuminated. However, because the earth surface is illuminated, it will, especially when a sea surface is concerned, act as a flat conducting metal plate with respect to the transmitted carrier wave. The result will be that the electric field near the earth surface will be disposed practically perpendicularly to the earth surface. Depending on the carrier wave frequency, this vertical polarisation will, within certain limits, reach to great heights above the earth surface. This vertical polarisation is not dependent on the orientation of the antenna unit, because the polarisation of the carrier wave is obtained as a result of interaction with the earth surface. An additional condition is that the frequency of the carrier wave is sufficiently low.

A special advantage of the invention is that the need is obviated to give the antenna unit a required orientation. This implies a tremendous simplification and improvement of the system. Moreover, the system's construction can be much cheaper.

For example, no means are required for determining the orientation of the antenna unit with respect to space. As a result, no software is required to process this orientation for calculation of the angular spin position of the object. Operation of the system is therefore quicker and more accurate.

It is especially advantageous that according to the invention the antenna unit does not require stabilisation when it is placed on a ship. As a result the expenses of a complete stabilised platform can be saved.

According to a special embodiment of the invention, for transmission of the carrier waves use may even be made of a communication antenna already present on a vehicle, because according to the invention, the antenna unit does not need to satisfy any special requirements. On a ship, such a communication antenna is usually a single wire. Furthermore, the system according to the invention has the advantage that due to the wider transmitting antenna beam several objects can simultaneously be illuminated for determination of their respective orientations with respect to space.

The vertical direction of the electric field or the horizontal direction of the magnetic field will reach further above the earth surface as the frequency becomes lower, or as the antenna unit is placed closer to the earth surface. The frequency of the at least one carrier wave will therefore preferably be low, for instance in the order of 50 kHz. The polarisation direction of the carrier wave can be determined by the receiving system of the object on the basis of the direction of the electric field, the magnetic field or a combination of both. Here the receiving antenna means comprises for example two dipole antennas, where the receiving system is suitable for determination of the orientation of the object with respect to the electric field. Because the electric field is perpendicularly disposed to the earth surface, the magnetic field will be parallel with the earth surface. As a result, it is also possible to determine the orientation of the object with respect to the magnetic field component of the electromagnetic field. For this purpose, the receiving antenna means is for example provided with two loop antennas. Moreover, it is possible to use both components of the polarised electromagnetic field in combination for determining the orientation of the object. For this purpose the object is preferably provided with at least one dipole antenna and at least one loop antenna which are not perpendicularly disposed with respect to each other.

BRIEF DESCRIPTION OF THE DRAWING

The invention will now be described in more detail with reference to the accompanying figures, of which

DESCRIPTION OF THE PREFERRED EMBODIMENTS

Figure 1:
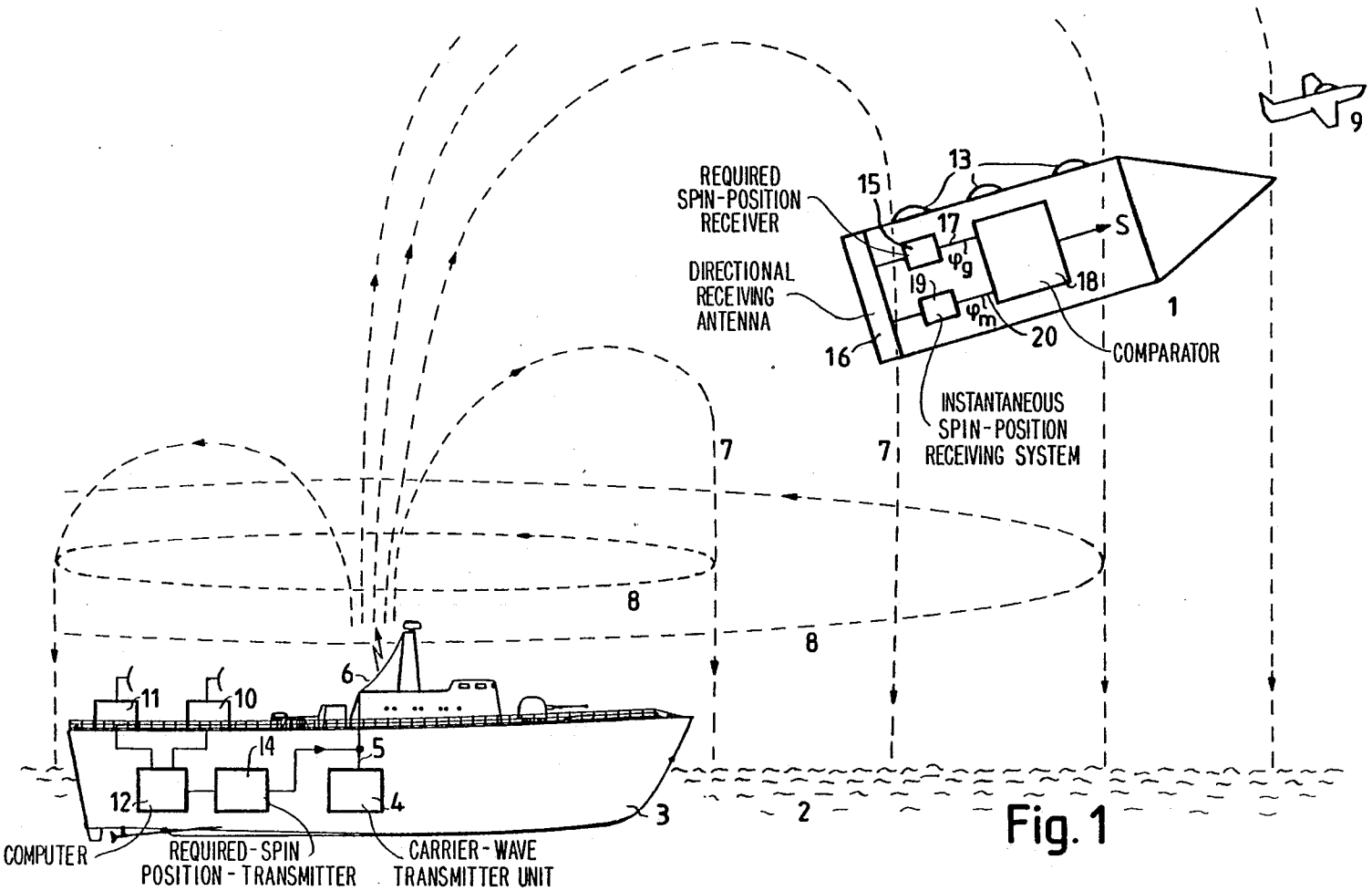
FIG. 1 is a special embodiment of the system, where the transmitter and antenna unit is placed on a ship.

In FIG. 1 an object 1 is present above the earth surface 2 where the angular spin position of object 1 needs to be determined. The earth surface 2 in this case is a sea surface. It may however also be somewhat damp land surface. A ship 3 is provided with a transmitter unit 4 which is linked with antenna unit 6 via line 5. Antenna unit 6 concerns a single wire which can be fitted on the ship in any position and having any orientation. Transmitting system 4 is suitable for transmitting a carrier wave having frequency $\omega_o$. Antenna unit 6 is of such a type that, in the first place, the carrier wave reaches down to earth surface 2 and, in the second place, the carrier wave reached up high above the earth surface 2 as a result of which object 1 is within the electromagnetic field of the carrier wave. Because, in the third place, the frequency of the carrier wave is relatively low (e.g. around 50 kHz). the carrier wave will at any distance from the ship be of the vertically polarised type, in spite of the fact that the antenna unit transmits a polarised carrier wave of which the polarisation direction is unknown.

The condition described above is caused by the fact that the earth surface, if the carrier wave frequency is sufficiently low, acts as a flat conducting plate. Electric field component 7 of the carrier wave has a vertical direction, while magnetic field component 8 has a horizontal direction. The polarisation will reach further above surface 2 as the frequency of the carrier wave is lower and the distance between the antenna unit 6 with respect to the earth surface decreases. The accuracy of the horizontal or vertical polarisation to $\pm 3°$ in the field of application.

Antenna unit 6 is of an especially simple and cost-effective type, viz. a single wire. No use is made, as in conventional systems, of a stabilised platform onto which the antenna unit is fitted. The antenna unit will therefore continuously change orientation as a result of the rolling movement of the ship. Moreover, the antenna unit is unsuitable for transmitting polarised carrier waves, having as an advantage that the length of the antenna unit can be limited. In this case, the antenna unit 6 concerns a communication antenna already present on the ship.

In FIG. 1 it is furthermore assumed that object 1 functioning as a projectile has been fired to hit target 9. The course of the target is tracked from the ground by means of tracking means 10. For this purpose, e.g. use can be made of a monopulse radar tracker operable in the K.band, or of a pulsed laser tracking means, which operates in the far infrared area. The course of projectile 1 can be tracked by comparable target tracking means 11. A computer 12, on the basis of target positions determined and supplied by target tracking means 10 and on the basis of projectile positions determined and supplied by target tracking means 11, determines whether and, if so, which course correction of the projectile is required. To obtain any course correction, the projectile is fitted with gas discharge units 13. Because the projectile spins about its axis, to achieve a course correction a gas discharge unit is to be activated when the projectile is in the right position.

To determine the right position, use is made of carrier waves transmitted by means of transmitter unit 4 and antenna unit 6. Computer 12 determines the required angular spin position $\phi_g$ of the projectile where a gas explosion is to occur with respect to the polarised electromagnetic field pattern of the carrier waves at the projectile.

According to the present invention, determination of this value $\phi_g$ is independent of the instantaneous position and orientation of the antenna unit with respect to the earth surface. This implies that it is not necessary to correct the ship's movements. This enables the antenna unit 6 to be directly fitted to the ship, obviating the need for a stabilised platform. The calculated value $\phi_g$ is transmitted by means of transmitter 14. This transmitter uses antenna unit 6. A receiver 15, included in the projectile, receives by means of a receiving antenna means 16 the value $\phi_g$ transmitted by transmitter 14. The received value $\phi_g$ is supplied to comparator 18 via line 17.

A receiving system 19, fed by the antenna signals of the two directional antennas included in receiving antenna means 16 determines the instantaneous position $\phi_m(t)$ of the projectile with respect to the electromagnetic field at the receiving antenna means. The instantaneous value $\phi_m(t)$ is determined with respect to the earth surface because the electric field component 7 of the carrier wave has a vertical direction and the magnetic field component 8 has a horizontal direction. The instantaneous value $\phi_m(t)$ is supplied to comparator 18 via line 20. When the condition $\phi_m(t)=\phi_g$ has been fulfilled, comparator 18 delivers a signal S to activate the gas discharge units 13. At this moment a course correction is made. Thereafter this entire process can be repeated if a second course correction is required.

Figure 2:
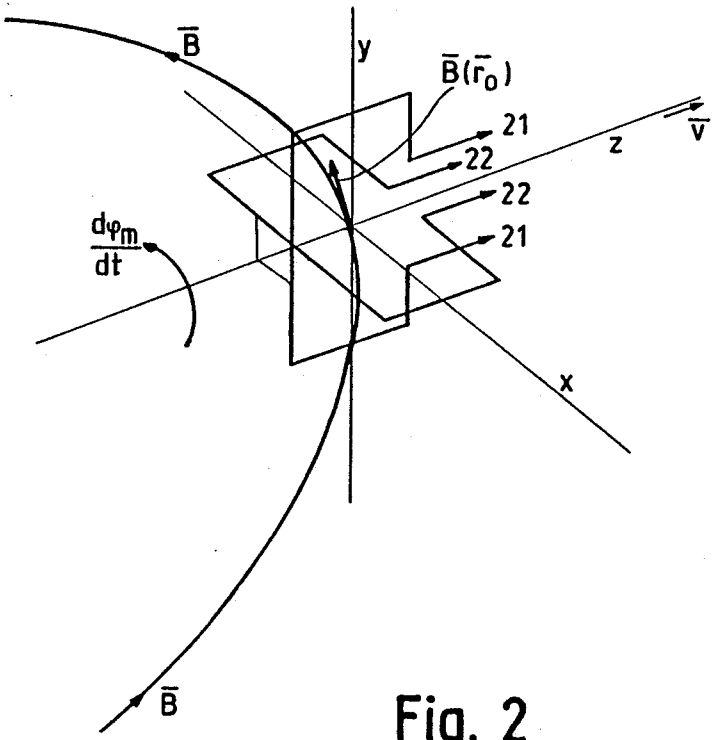
FIG. 2 is a schematic representation of two perpendicularly disposed loop antennas placed in an electromagnetic field.
Figure 3:
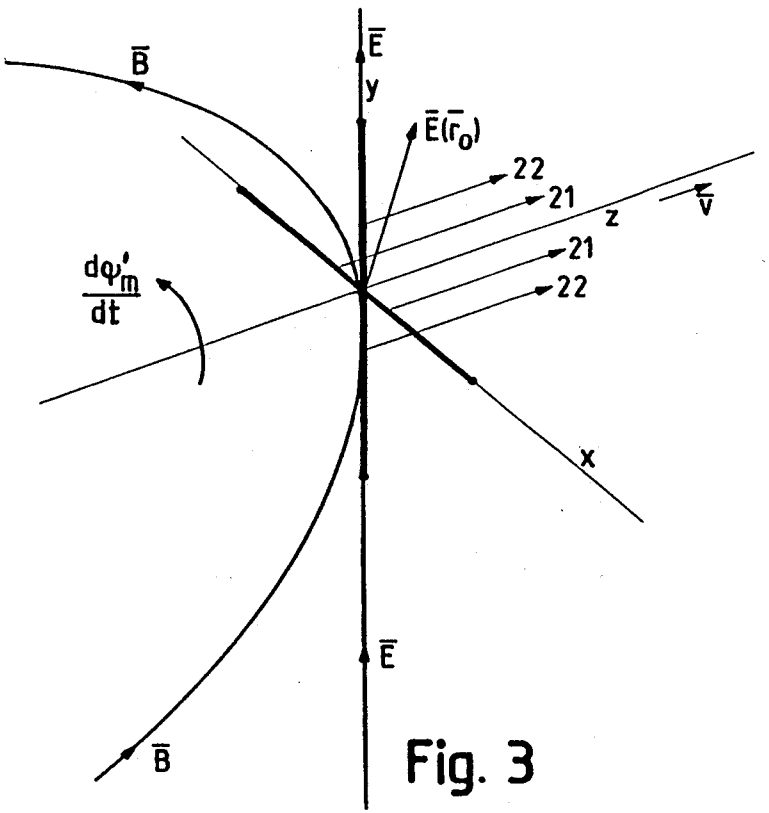
FIG. 3 is a schematic representation of two perpendicularly disposed dipole antennas placed in an electromagnetic field.

FIG. 2 and FIG. 3 show the two perpendicularly disposed directional antennas 21 and 22, forming part of the receiving antenna means 16. The receiving antenna means may comprise B field or E field antennas. It is also possible to use one E field and one B field antenna which are not perpendicularly and preferably parallelly disposed. If two B field antennas are applied (such as represented in FIG. 2), the magnetic field component $\overline{B}$ of an electromagnetic field is detected. If two E field antennas are applied (such as represented in FIG. 3), the electric field component $\overline{E}$ of an electromagnatic field is detected. If one B field and one E field antenna are applied, one subcomponent of field component $\overline{E}$ and one subcomponent of field component $\overline{B}$ are detected. Because field components $\overline{E}0$ and $\overline{B}$ are connected by means of the so-called relation of Maxwell, it will suffice to measure at least one of the components $\overline{E}$ or $\overline{B}$, or one subcomponent of component $\overline{E}$ and one subcomponent of the component $\overline{B}$.

For measuring the $\overline{B}$ (sub)component, a loop antenna can be used, while a dipole antenna may be used for measuring the $\overline{E}$ (sub)component.

An x,y,z coordinate system is coupled to the loop antennas of FIG. 2. The propagation direction $\overline{v}$ of the projectile is parallel to the z-axis. The magnetic field component $\overline{B}$, transmitted by transmitter 14, has the magnitude and direction $\overline{B}(\overline{r}_o)$ at the location of the loop antennas. Here $\overline{r}_o$ is the vector with the transmitter unit 4 as origin and the origin of the x,y,z coordinate system as end point. As a reference for determining the angular spin position of the projectile, use is made of angle $\phi_m(t)$ between the x-axis and the field component $\overline{B}$. This implies that $\phi_m(t)$ represents the angle between the x-axis and the earth surface. The magnetic field component $\overline{B}(\overline{r}_o)$ can be resolved into a component $\overline{B}(\overline{r}_o)_{||}$ (parallel to the z-axis) and the component $\overline{B}(\overline{r}_o)_{\perp}$ (perpendicular to the z-axis), see FIG. 4. Only the component $\overline{B}(\overline{r}_o)_{\perp}$ can generate an induction voltage in the two loop antennas. For the area on both sides of the ship, $\overline{B}(\overline{r}_o)$ is always parallel to the earth surface. Only the magnitude of $\overline{B}(\overline{r}_o)$ changes as a function of $\overline{r}_o$, however, this is not important for position determination.

Figure 5:
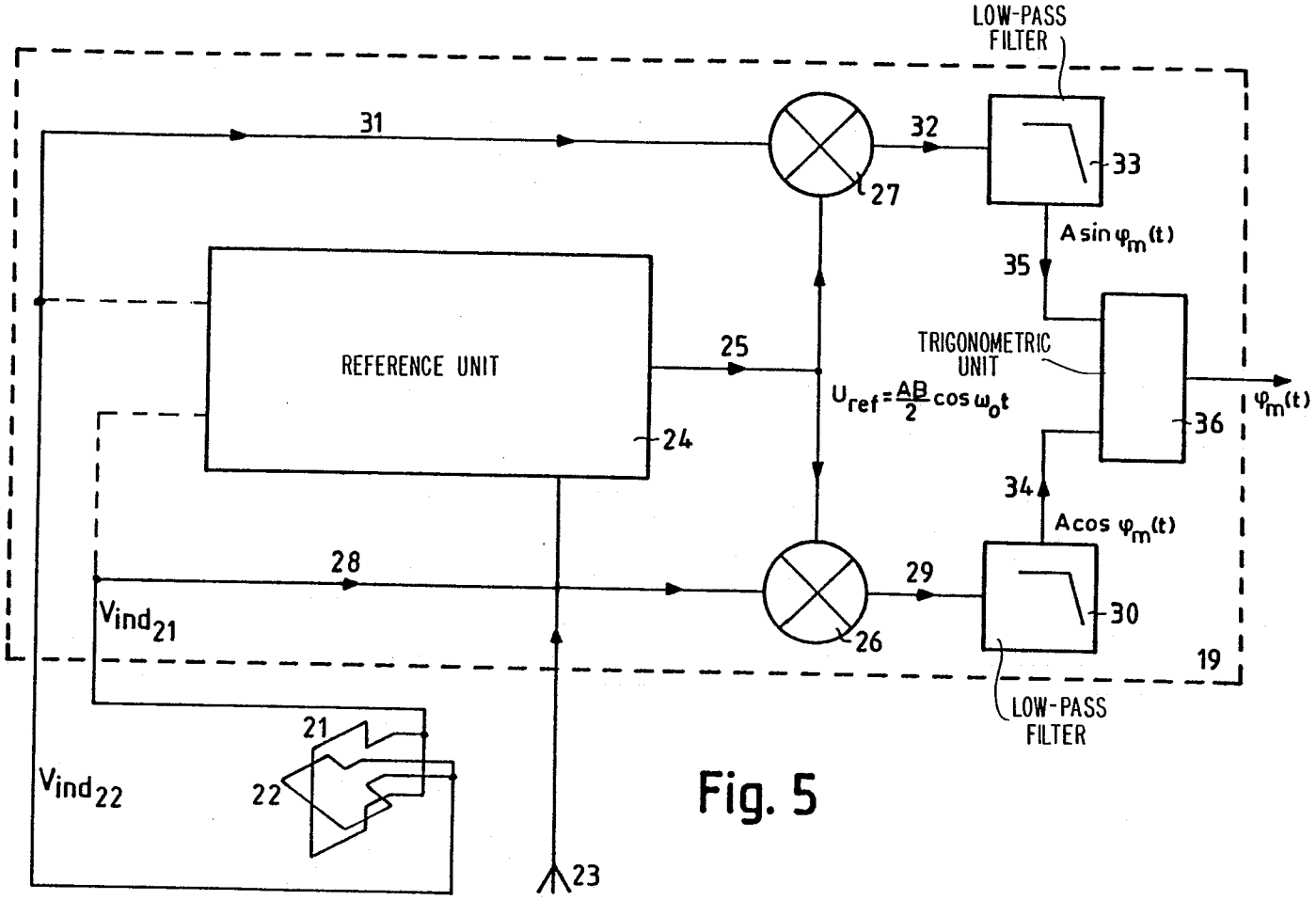
FIG. 5 shows a schematic representation of the receiving system included in a projectile to determine the angular spin position of the projectile.

FIG. 5 is a schematic representation of the receiving system 19. In the embodiment of system 19 in FIG. 5 it is assumed that the transmitter sends out an electromagnetic field consisting of a polarised carrier wave with frequency $\omega_o$. The magnetic field component $\overline{B}_{\perp}(\overline{r}_o)$ can be defined as $$\overline{B}_{\perp}(\overline{r}_o) = (a \sin \omega_o t)\overline{e}, \text{ where } \frac{\overline{B}_{\perp}(\overline{r}_o)}{|B_{\perp}(r_o)|} = \overline{e} \tag{1}$$

The magnetic flux $\Phi_{21}$ through the loop antenna 21 can be defined as:

$$\Phi_{21}=(a \sin \omega_o t)\cdot S\cdot \cos \phi_m(t) \tag{2}$$

In this formula, S is equal to the area of the loop antenna 21.

The magnetic flux $\Phi_{22}$ through loop antenna 22 can be defined as:

$$\Phi_{22}=(a \sin \omega_o t)\cdot S\cdot \sin \phi_m(t) \tag{3}$$

The induction voltage in loop antenna 21 is now equal to:

$$V_{ind21} = -\epsilon \frac{d\phi}{dt} = -\epsilon(a\ \omega_o \cos \omega_o t)\cdot S\cdot \cos \phi_m(t) + + -\epsilon(a \sin \omega_o t)\cdot S\cdot \sin \phi_m(t)\cdot \frac{d\phi_m}{dt} \tag{4}$$

Here $\epsilon$ is a constant which is dependent upon the used loop antennas 21, 22. Since the projectile speed of rotation ($d\phi_m/dt$) is much smaller than the angular frequency $\omega_o$, it can be approximated that:

$$\begin{aligned} V_{ind21} &= -\epsilon(a\ \omega_o \cos \omega_o t)\omega_o(t)\cdot S\cdot \cos \phi_m(t) = \\ &= (A \cos \omega_o t)\cdot \cos \phi_m(t) \end{aligned} \tag{5}$$

Similarly, for loop antenna 22:

$$V_{ind22} = (A \cos \omega_o t)\cdot \sin \phi_m(t) \tag{6}$$

It follows from formulas (5) and (6) that:

$$\tan \phi_m(t) = \frac{V_{ind22}}{V_{ind21}} \tag{7}$$

Thus $\phi_m(t)$ can be determined with an uncertainty of 180°. To eliminate the 180° uncertainty, a so-called test course correction can be carried out. Here it is assumed that $\phi_m(t)$ is known. Transmitter unit 4 generates a value $\phi_g$ where a course correction is carried out. For this purpose the value of $\phi_g$ is transmitted by means of transmitter 14. If the projectile as a result carries out a course correction, target tracking means 10, 11 can be used to establish whether a correction is carried out in the $\phi_g$ direction or in the $\phi_g+180°$ direction. Subsequently the proper course corrections can ba carried out.

It is however also possible to eliminate the 180° uncertainty without carrying out a test course correction. For this purpose, transmitter 14 also transmits an electromagnetic wave E where $$E(t)=G(t) \cos \omega_1 t \text{ with } G(t)=D\cdot(1-\beta\ \omega_0 t).$$

In this formula D is a constant and $\beta$ the modulation depth, so that $0<\beta<1$. Also, $\omega_1>>\omega_0$. According to this embodiment, frequency $\omega_1$ is FM modulated to comprise the information concerning $\phi_g$. The electromagnetic wave is therefore modulated with $\cos \omega_o t$ and thus comprises phase information of the signal transmitted by antenna unit 6. The receiving antenna means 16 is provided with an antenna 23 for the reception of signal E(t). Antenna 23 is linked with a reference unit 24, which generates a reference signal $U_{ref}$ from the received signal E(t), with $$U_{ref}=C \cos \omega_o t\,. \tag{8}$$

Here C is a constant which is dependent upon the specific embodiment of reference unit 24. The $U_{ref}$ signal is supplied to mixers 26 and 27 via line 25.

Signal $V_{ind21}$ (t) is also applied to mixer 26 via line 28. The output signal of mixer 26 is applied to low-pass filter 30 via line 29. The output signal $U_{30}(t)$ of the low-pass filter 30 (the component of frequency ($d\phi_m/dt$) is equal to:

$$U_{30}(t) = \frac{AC}{2} \cos \phi_m(t) \quad (9)$$

In a fully analogous way, signal $V_{ind22}(t)$ is fed to mixer 27 via line 31. The output signal of mixer 27 is fed to a low-pass filter 33 via line 32. Output signal $U_{33}(t)$ of the low-pass filter 33 is equal to:

$$U_{33}(t) = \frac{AC}{2} \sin \phi_m(t) \quad (10)$$

From formula (9) and (10) and for a given $U_{30}(t)$ and $U_{33}(t)$, it is simple to determine $\phi_m(t)$. To this effect, signals $U_{30}(t)$ and $U_{33}(t)$ are sent to a trigonometric unit 36 via lines 34 and 35. In response to these signals, trigonometric unit 36 generates $\phi_m(t)$. Trigonometric unit 36 may, for instance, function as a table look-up unit. It is also possible to have the trigonometric unit functioning as a computer to generate $\phi_m(t)$ via a certain algorithm.

Figure 6:
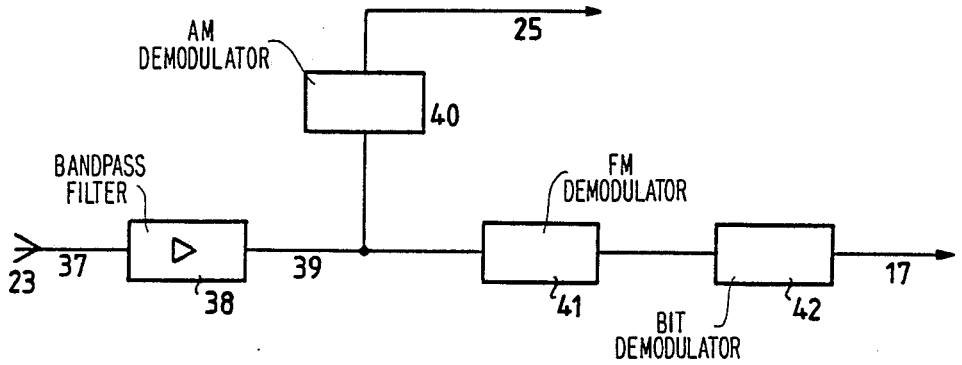
FIG. 6 is a first embodiment of a unit from FIG. 5.

FIG. 6 represents an embodiment of reference unit 24. Antenna signal E(t) is supplied to a bandpass filter 38 via line 37. Bandpass filter 38 only passes signals with a frequency of around $\omega_1$. Signal B(t) will therefore not be passed. Signal E(t) is subsequently supplied to an AM demodulator 40 via line 39 to obtain $U_{ref}$ on line 25. The reference unit may be additionally provided with an FM demodulator 41 and a bit demodulator 42. In that case, signal E(t) is also used as an information channel. The information is FM modulated and transmitted with signal E(t). This enables the required angle $\phi_g$ to which the correction of the projectile is to be carried out to be received, FH demodulated and bit demodulated from signal E(t). In this case, receiver 15 of FIG. 1 is not required because reference unit 24 determines $\phi_g$ by itself.

Figure 7:
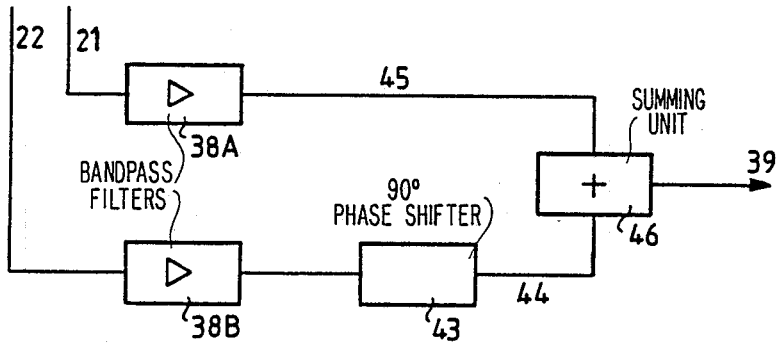
FIG. 7 is a second embodiment of a unit from FIG. 5.

FIG. 7 represents a special embodiment of reference unit 24. According to this embodiment, the task of antenna 23 is replaced by both antennas 21 and 22. For this purpose, reference unit 24 is Provided with two bandpass filters 38A and 38B having the same function as the bandpass filter 38 of FIG. 6. The output signal of bandpass filter 38B is supplied to a 90° phase shifter 43. The output signal of phase shifter 43 is supplied via line 44 to summing unit 46. Owing to the 90° phase shifter 43, the signals when summed will supplement each other and an output signal will be obtained having a constant amplitude. The output signal of summing unit 46 is equal to the signal on line 39 as described in FIG. 6.

The output signal of summing unit 46 is processed by means of an AM demodulator 40. FM demodulator 41 and bit demodulator 42 in the same way as described for FIG. 6.

In FIG. 2 the directional antennas are represented as two loop antennas. However, it is also possible to use two perpendicularly disposed dipole antennas. In that case, the E field instead of the B field of the electromagnetic field is measured. As the E field is perpendicular to the earth surface, the angular spin position of the projectile is measured directly with respect to the earth surface. The dipole antennas are preferably positioned perpendicularly to the surface of the former loop antennas, see FIG. 3.

FIG. 3 represents, besides the B field, also the E field. In this case, the E field instead of the B field as represented in FIG. 2 now functions as reference for measurement of the instantaneous angular position $\phi'm(t)$ of the projectile. A first dipole antenna is for this purpose positioned parallel with the x axis, while a second dipole antenna is positioned parallel with the y axis.

Figure 8:
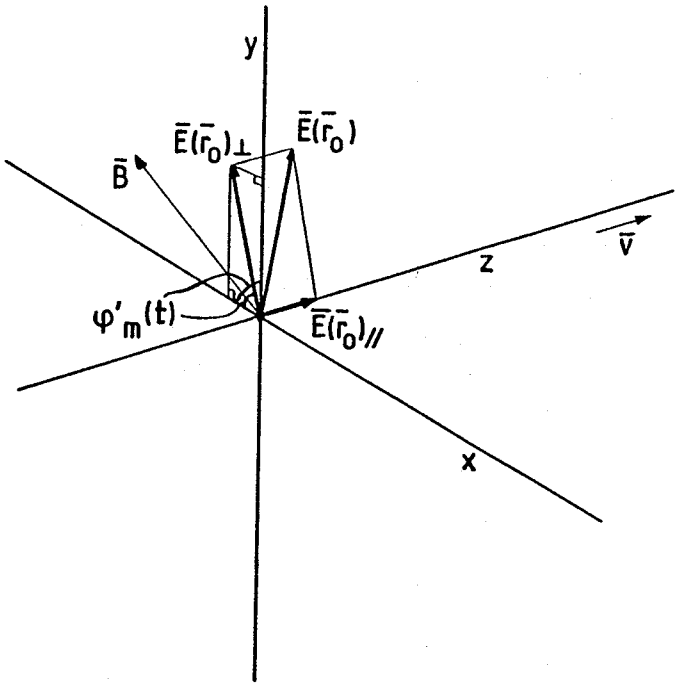
FIG. 8 is a diagram of an electric field at the location of the dipole antennas.

The E field at the dipole antennas is described by $\overline{E}(\overline{r}_o)$, FIG. 3. The E field can be disintegrated into two components $\overline{E}(\overline{r}_o)_{||}$ and $\overline{E}(\overline{r}_o)_{\perp}$ as represented in FIG. 8. Only the $\overline{E}(\overline{r}_o)_{\perp}$ component will generate a voltage in the dipole antennas.

The field $\overline{E}(\overline{r}_o)_{\perp}$ component can be expressed by:

$$\overline{E}(\overline{r}_o)_{\perp} = a' \cos \omega_o t \overline{e} \quad (11)$$

with $$\overline{e} = \frac{\overline{E}(\overline{r}_o)_{\perp}}{|\overline{E}(\overline{r}_o)_{\perp}|} \quad (12)$$

Voltage $V'_{21}$ in the dipole antenna parallel with the x axis is equal to:

$$V'_{21} = \overline{E}(\overline{r}_o)_{\perp} \cos \phi'_m(t) \cdot h_x \quad (13)$$

where $h_x$ is the length of the dipole antenna and $\phi'_m(t)$ the angle between the x axis and $\overline{E}(\overline{r}_o)_{\perp}$. This angle equals the angle between the x axis and $\overline{E}(\overline{r}_o)$. In a fully analogous way, voltage $V'_{22}$ in the dipole antenna along the y axis is equal to $$V'_{22} = \overline{E}(\overline{r}_o)_{\perp} \sin \phi'_m(t) \cdot h_y \quad (14)$$

where $h_y$ is the length of the dipole antenna along the y axis. Combination of formulas (11), (13) and (14) results in:

$$V'_{21} = a' h_x \cos \omega_o t \cdot \cos \phi'_m(t) \quad (15)$$

$$V'_{22} = b' h_y \cos \omega_o t \cdot \sin \phi'_m(t) \quad (16)$$

Fully analogous to the description to formulas (12) and (13), angle $\phi'_m(t)$ can be determined from formulas (15) and (16) by means of the reference signal of formula (8). Thus the instantaneous position of the projectile with respect to the earth surface is determined because the E field is perpendicular to the earth surface.

Figure 9:
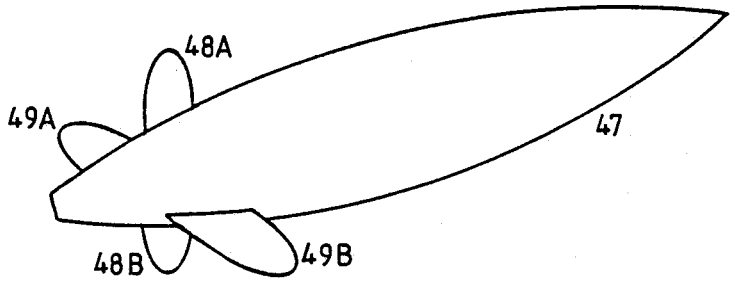
FIG. 9 is an embodiment of the projectile with dipole antennas.

A special embodiment of the dipole antennas is represented in FIG. 9. Projectile 47 in FIG. 9 is provided with two pairs of fins 48A, 48B, 49A and 49B. Fins 48A, 48B, like fins 49A, 49B, are positioned at opposite angles, while fins 48A and 49A on the one hand and 48B and 49B on the other hand are perpendicularly disposed. Fins 48A and 48B together form a first dipole antenna 21 and fins 49A and 49B form a second dipole antenna 22 perpendicularly disposed to dipole antenna 21. In this case, the fins also function like an antenna, for reception of the data signal. Signals $V'_{21}$, $V'_{22}$, $\phi'_m(t)$. $U_{ref}$ and $\phi_g$ can be determined by means of the fins as described above for FIG. 7.

It will be clear that it is not necessary to perpendicularly dispose the dipole antennas, loop antennas and/or fins. Moreover, for the sake of redundancy more than two antennas may be used. Thus for instance six fins may be fitted at a 60° angle.

If one dipole antenna and one loop antenna are used which are not perpendicularly disposed, the instantaneous angular spin position of the object can also be determined. If one dipole antenna 21 is parallel with a loop antenna 22 (parallel with the x axis), in a fully analogous way as described above:

$$V'_{21}=a'h_x \cos \omega_o t \cdot \cos \phi'_m(t) \quad (17)$$

$$V_{ind22}=A \cos \omega_o t \cdot \cos \phi_m(t) \quad (18)$$

Because $\overline{E}$ and $\overline{B}$ are perpendicularly disposed:

$$\phi'_m(t)=90^\circ-\phi_m(t) \quad (19)$$

Substitution of (19) in (17) will result in:

$$V'_{21}=a'h_x \cos \omega_o(t) \sin \phi_m(t) \quad (20)$$

It will be clear that on the basis of formulas (20) and (18) the value of $\phi_m(t)$ can be determined as described above because a', $h_x$ and A are also known.

Figure 4:
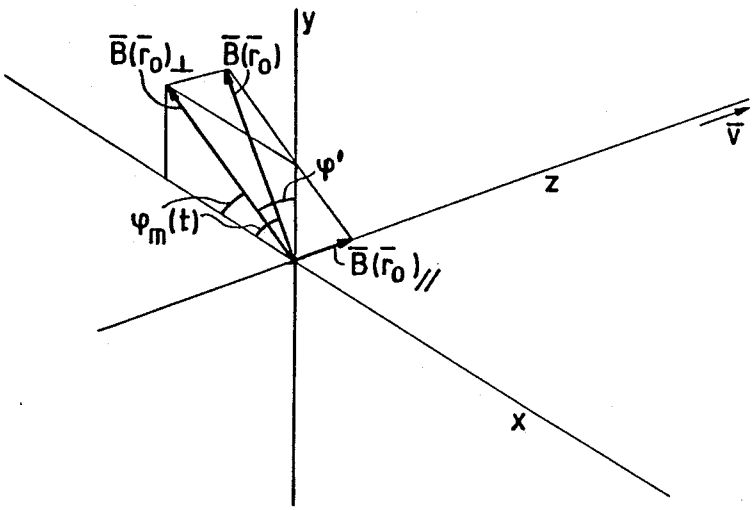
FIG. 4 is a diagram of a magnetic field at the location of the loop antennas.

An alternative method for determining the angular spin position concerns the transmission of two superimposed phase-locked and unpolarised carrier waves. The situation of the magnetic field in this case is as represented in FIG. 4.

A first carrier wave has a frequency $n\omega_o'$ and the second carrier wave has a frequency $(n+1)\omega_o'$ with $n=1, 2, \ldots$ The magnetic field component $\overline{B}_\perp(\overline{r}_o)$ can be expressed as:

$$\overline{B}_\perp(\overline{r}_o)=(a \sin n\, \omega_o' t=b \sin(n+1)\omega_o' \cdot t)\overline{e},$$

with $\overline{e}=\overline{B}(\overline{r}_o)_\perp/|\overline{B}(\overline{r}_o)_\perp|$ The magnetic flux $\Phi_{21}$ through loop antenna 21 can be expressed as:

$$\Phi_{21}=(a \sin n\omega_o' t+b \sin(n+1)\omega_o' t)\cdot 0 \cdot \cos \phi_m(t) \quad (21)$$

where 0 is the surface of loop antenna 21.

The magnetic flux $\Phi_{22}$ through loop antenna 22 is expressed as:

$$\phi_{22}=(a \sin n\omega_o' t+b \sin(n+1)\omega_o' t)\cdot 0 \cdot \sin \phi_m(t) \quad (22)$$

The induction voltage in loop antenna 21 is now:

$$V_{ind21} = -\epsilon \frac{d\phi}{dt} = -\epsilon\,(a\, n\omega_o' \cos n\omega_o' t + b(n+1)\omega_o' \cos(n+1)\omega_o' t) \cdot 0 \cdot \cos \phi_m(t) + -\epsilon\,(a \sin n\omega_o' t + b \sin(n+1)\omega_o' t) \cdot 0 \cdot \cos \phi_m(t) \cdot \frac{d\phi_m}{dt} \quad (23)$$

where $\epsilon$ is a constant which depends on the loop antennas 21 and 22 used.

However, now rotational speed $(d\phi_m/dt)$ of the projectile is much lower than the angle frequency $\omega$, so that it can be approximated that:

$$\begin{aligned} V_{ind21} &= -\epsilon(a\, n\omega_o' \cos n\omega_o' t + b(n+1)\omega_o' \cos(n+1)\omega_o' t) \cdot 0 \cdot \cos \phi_m(t) \\ &= (A \cos n\omega_o' t + B \cos(n+1)\omega_o' t) \cdot \cos \phi_m(t) \end{aligned} \quad (24)$$

Analogously, for loop antenna 22 applies:

$$V_{ind22}=(A \cos n\omega_o' t+B \cos(n+1)\omega_o' t)\cdot \sin \phi_m(t) \quad (25)$$

In receiving system 19 (FIG. 5), induction voltages $V_{ind21}$ and $V_{ind22}$ are supplied to reference unit 24. Reference unit 24 generates by means of signals $V_{ind21}$ and $V_{ind22}$ a reference signal $V_{ref}$ which is equal to:

$$V_{ref}=C \cos n\omega_o' t \quad (26)$$

where C is a constant which is dependent on the specific embodiment of reference unit 24. A possible embodiment of such a reference unit is discussed with reference to FIG. 10.

Signal $V_{ref}$ is supplied to mixers 26 and 27 (FIG. 5) via line 25. Signal $V_{ind21}(t)$ is also supplied to mixer 26 via line 28. The output signal of mixer 26 is sent via line 29 to low-pass filter 30. Output signal $U_{30}(t)$ of the low-pass filter 30 (the component with frequency $(d\phi_m/dt)$ is equal to:

$$U_{30}(t)=(AC/2)\cos \phi_m(t) \quad (27)$$

In a fully analogous way signal $V_{ind22}(t)$ is supplied to mixer 27 via line 31. The output signal of mixer 27 is supplied to low-pass filter 33 via line 32. Output signal $U_{33}(t)$ of the low.pass filter 33 is equal to:

$$U_{33}(t)=(AC/2)\sin \phi_m(t) \quad (28)$$

As mentioned before, from formulas (27) and (28), with a given $U_{30}(t)$ and $U_{33}(t)$, $\phi_m(t)$ is easily determined.

Figure 10:
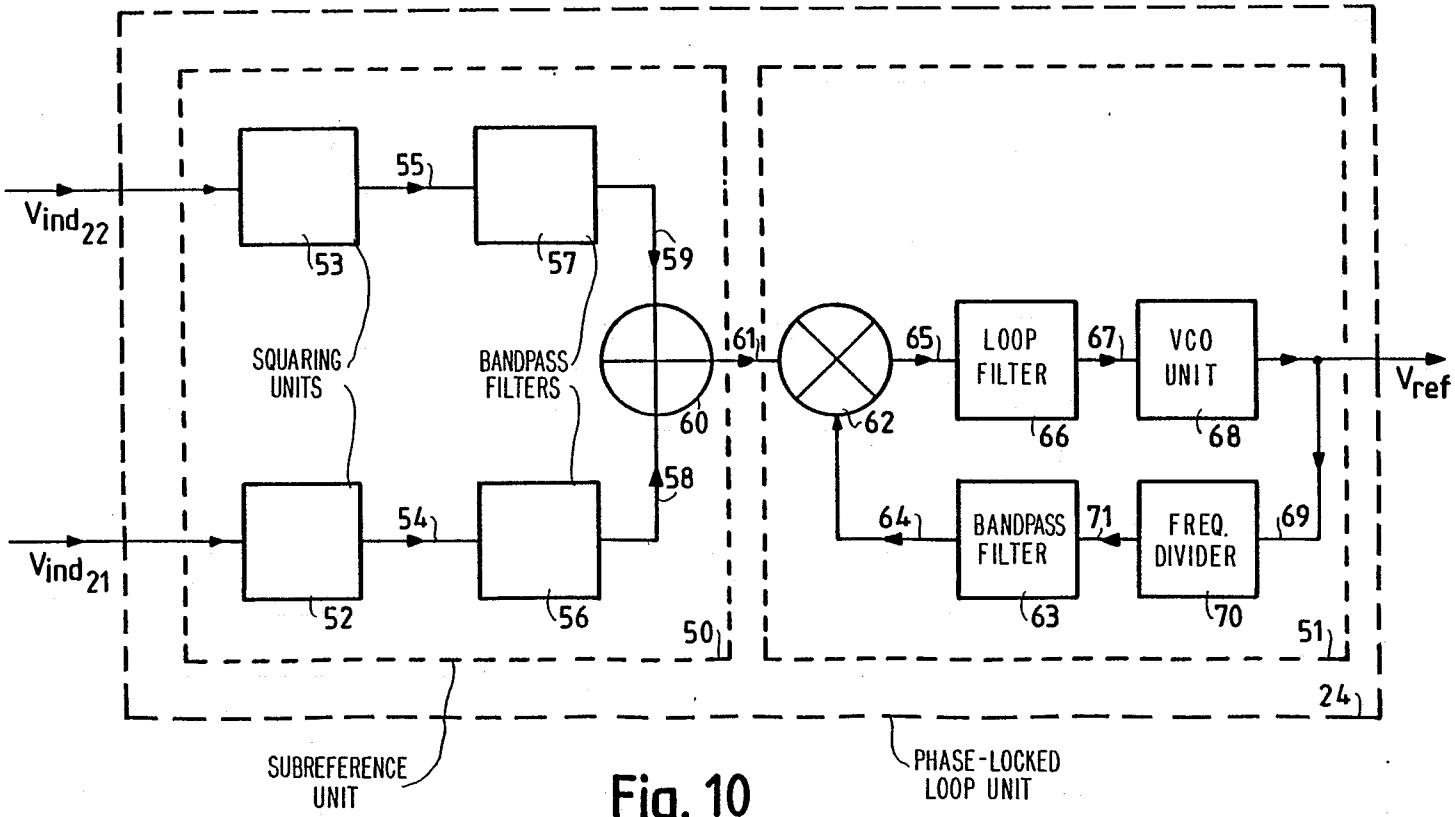
FIG. 10 is a special embodiment of a reference unit of FIG. 5.

A possible embodiment of reference unit 24, which finds application when two superimposed and phase.-locked carrier waves are transmitted, is represented in FIG. 10. Reference unit 24 consists of a subreference unit 50 and a phase locked loop unit 51. Subreference unit 50 generates from $V_{ind21}(t)$ and $V_{ind22}(t)$ a signal $$U_{ref}'=(AB/2)\cos \omega_o' t.$$

The phase-locked loop unit 51 generates by means of signal $U_{ref}'$ the above-mentioned signal $U_{ref}=(AB/2)\cos n\omega_o' t$.

Subreference unit 50 is provided with two squaring units 52 and 53, which square signals $V_{ind21}(t)$ and $V_{ind22}(t)$ respectively.

Squaring unit 52 therefore generates the signal:

$$\begin{aligned} U_{52}(t) = V_{ind21}^2(t) = {} & A^2\sin^2\phi_m(t)(\tfrac{1}{2} + \tfrac{1}{2}\cos 2n\omega_o' t) + \\ & + AB \sin^2\phi_m(t)(\tfrac{1}{2}\cos \omega_o' t + \tfrac{1}{2}\cos(2n+1)\omega_o' t) + \\ & + B^2\sin^2\phi_m(t)(\tfrac{1}{2} + \tfrac{1}{2}\cos(2n+2)\omega_o' t) \end{aligned} \quad (29)$$

while squaring unit 53 generates the signal $$U_{53}(t) = V^2_{ind22}(t) = A^2\cos^2\phi_m(t)(\tfrac{1}{2} + \tfrac{1}{2}\cos 2n\omega_o't) + AB\cos^2\phi_m(t)(\tfrac{1}{2}\cos\omega_o't + \tfrac{1}{2}\cos(2n+1)\omega_o't) + B^2\sin^2\phi_m(t)(\tfrac{1}{2} + \tfrac{1}{2}\cos(2n+2)\omega_o't) \quad (30)$$

The output signals of squaring units 52 and 53 are supplied via lines 54 and 55 respectively to bandpass filters 56 and 57 respectively. Bandpass filters 56 and 57 only pass signals with a frequency equal or substantially equal to $\omega_o$. Bandpass filter 56 therefore shows at the output the signal $$U_{56}(t)=AB\sin^2\phi_m(t)\cdot\tfrac{1}{2}\cos\omega_o't \quad (31)$$

In formula (31) too, it is assumed that $(d\phi_m(t)/dt) >> \omega_o'$.

In a fully analogous way bandpass filter 57 shows at the output the signal (see formula (30)):

$$U_{57}(t)=AB\cos^2\omega_m(t)\cdot\tfrac{1}{2}\cos\omega_o't \quad (32)$$

Signals $U_{56}(t)$ and $U_{57}(t)$ are supplied via lines 58 and 59 respectively to summing unit 60 to obtain the summing signal for which (see formulas 31 and 32):

$$U_{ref}'(t)=U_{60}(t)=(AB/2)\cos\omega_o't \quad (33)$$

Signal $U_{ref}'(t)$ is sent to phase-locked loop unit 51 via line 61.

Input signal $U_{ref}'(t)$ of unit 51 is applied to a mixer 62 via line 61. Let us assume that the second input signal of mixer 62, the output signal $U_{63}(t)$ of bandpass filter 63 which only passes signals with a frequency equal or substantially equal to $\omega_o'$ and which is supplied to mixer 62 via line 64, has the form $$U_{63}(t)=D\cos\omega t \quad (34)$$

where D is a random constant. The output signal of mixer 62 will then have the form:

$$U_{62}(t)=(AB/2)\cos\omega t\cos\omega_o't \quad (35)$$

Signal $U_{62}(t)$ is supplied to a loop filter 66 via line 65.

Loop filter 66 has an output signal $U_{66}(t)$ which is equal to:

$$U_{66}(t)=E\cdot(\omega_o'-\omega) \quad (36)$$

where E is a constant which is dependent on the filter used.

Signal $U_{66}(t)$ is supplied to VCO unit 68 via line 67. VCO unit 68 generates an output signal for which applies:

$$U_{68}(t)=K\cos(\omega_o''+k\,E(\omega_o'-\omega))t \quad (37)$$

In this formula $\omega_o''$, k and K are constants, where $\omega_o''=\omega_o'n$.

Signal $U_{68}(t)$ is supplied to a frequency divider (n) 70 via line 69.

The output signal of the frequency dividar can be expressed as:

$$U_{70}(t)=K\cos)\omega_o'+(kE/n)(\omega_o'-\omega))t \quad (38)$$

Output signal $U_{70}(t)$ is supplied via line 71 to bandpass filter 63 which passes signals with a frequency equal or substantially equal to $\omega_o'$. If $kE/n(\omega_o'-\omega)<<\omega_o'$, the output signal of bandpass filter 63 will be:

$$U_{63}(t)=K\cos(\omega_o'+(kE/n)(\omega_o'-\omega))t \quad (39)$$

Comparison of formula (39) with formula (34) proves that $D=K$; $\omega=\omega_o'$. Thus it has been proven that for the output signal of VCO unit 68 (see formula 37) the following is true:

$$V_{ref}=U_{68}(t)=K\cos n\,\omega_o't \quad (40)$$

By means of $V_{ref}$, $\phi_m(t)$ can be calculated with respect to the earth surface as described above.

It will be clear that many possibilities exist to determine the angular spin position of the object by means of carrier waves transmitted by a transmitting antenna of which the position and orientation are not determined. Moreover, it is not necessary that the transmitted carrier waves are transmitted by a polarised transmitting antenna. The above-described determination of the angular spin position for correction of the course of a projectile is therefore only an example of a possible application.

I claim:

1. A system for determining the angular spin position of an object spinning about an axis situated within certain limits near the surface of a celestial body, where the system is provided with a transmitter unit and an antenna unit linked to the transmitter unit, which antenna unit generates at least one carrier wave reaching as far as the object and extending by the object and to the surface with a predetermined polarization direction, where the system is further provided with directional receiving antenna means fitted to the object and a receiving system linked to the receiving antenna means which receiving system receives the carrier wave and determines the angular spin position of the object with respect to the surface on the basis of the angular spin position of the object with respect to the polarization direction of the carrier wave, said polarization direction of the carrier wave being substantially maintained by interference with said surface, regardless of the position and orientation of the antenna unit with respect to said surface.

2. A system as claimed in claim 1, characterised in that the position and orientation of the antenna with respect to the surface is indeterminate.

3. A system as claimed in claim 1, characterised in that the antenna unit is mechanically connected to a vehicle.

4. A system as claimed in claim 3, characterized in that the vehicle is a ship.

5. A system as claimed in claims 3 or 4, characterised in that the antenna unit is substantially rigidly connected to the vehicle.

6. A system as claimed in claims 3 or 4, characterised in that the antenna unit is provided with a mobile and flexible wire.

7. A system as claimed in claims 3 or 4 provided with a communication system comprising a communication transmitting and receiving antenna, which also functions as an antenna unit.

8. A system as claimed in claim 3 or 4, characterised in that the transmitter unit is suitable for transmitting two phase-locked and superimposed carrier waves having a different carrier wave frequency.

9. A system as claimed in claim 8, characterised in that the receiving antenna means is provided with a first and a second directional antenna and where the receiving system is provided with:

a. a reference unit to obtain a reference signal from the superimposed carrier waves received by means of the first and the second antenna, which reference signal has a frequency which is equal to one of the frequencies of the said carrier waves.

b. a first and a second mixer for mixing with said reference signal at least one carrier wave component of the superimposed carrier waves received by means of the first or the second antenna.

c. a first and a second filter unit for filtering the output signals of said first and second mixers, said filters passing only frequency components equal or substantially equal to zero.

d. a trigonometric unit controlled by the output signals of the first and second filters, which trigonometric unit generates a signal representing the instantaneous angle between one of the loop antennas and the polarisation direction of the superimposed carrier waves.

10. A system as claimed in claim 1, characterised in that the transmitting unit is suitable for transmitting at least one first carrier wave and a second carrier wave having a modulation comprising a predetermined phase relation with the phase of the frequency of the first carrier wave.

11. A system as claimed in claim 10, characterised in that the modulation consists of an amplitude modulation.

12. A system as claimed in claims 10 or 11, where the receiving antenna means is provided with a first and a second directional antenna and where the receiving system is provided with:

a. a reference unit for obtaining a reference signal from the second carrier wave received by means of the receiving antenna means, the phase of the said reference signal having a predetermined relation with the phase of the frequency of the said first carrier wave.

b. a first and a second mixer for mixing with said reference signal the first carrier wave received by means of the first or the second antenna.

c. a first and a second filter unit for filtering the output signals of said first and second mixers, said filters passing only frequency components equal or substantially equal to zero.

d. a trigonometric unit controlled by the output signals of the first and second filters, which trigonometric unit generates a signal representing the instantaneous angle of the polarisation direction of the carrier wave with respect to the receiving antenna unit with an uncertainty of 180°.

13. A system as claimed in claim 12, characterised in that the receiving antenna means comprises at least a third antenna for receiving the second carrier wave.

14. A system as claimed in claim 12, characterised in that the second carrier wave is received by means of the first and second directional antennas.

15. A system as claimed in claim 1, characterised in that the receiving antenna means comprises at least two dipole antennas having different orientations, for determination of the angular spin position of the object on the basis of the direction of the electric field component of the electromagnetic field.

16. A system as claimed in claim 1, characterized in that the receiving antenna means comprises at least two loop antennas, having different orientations, for determination of the angular spin position of the object on the basis of the direction of the magnetic field component of the electromagnetic field.

17. A system as claimed in claim 1, where the receiving antenna means comprises at least one dipole antenna and at least one loop antenna which is not perpendicularly disposed to the dipole antenna for determination of the angular spin position of the object on the basis of the direction of an electric and magnetic subfield component of the electromagnetic field.

18. A system as claimed in claim 1, characterised in that the at least one carrier wave has a frequency of around 50 kHz.

* * * * *